US008136933B2

(12) United States Patent
Jones

(10) Patent No.: US 8,136,933 B2
(45) Date of Patent: Mar. 20, 2012

(54) SOLID INK MELT TUB WITH CORRUGATED MELT REGION AND OFFSET OUTLET

(75) Inventor: Brent Rodney Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 588 days.

(21) Appl. No.: 12/362,612

(22) Filed: Jan. 30, 2009

(65) Prior Publication Data

US 2010/0194835 A1 Aug. 5, 2010

(51) Int. Cl.
*B41J 2/175* (2006.01)

(52) U.S. Cl. ..... 347/88

(58) Field of Classification Search ..... 347/88, 347/99

See application file for complete search history.

(56) References Cited

U.S. PATENT DOCUMENTS

| | | | | |
|---|---|---|---|---|
| 4,771,920 A | | 9/1988 | Boccagano et al. | |
| 5,442,387 A | * | 8/1995 | Loofbourow et al. | 347/88 |
| 5,621,444 A | | 4/1997 | Beeson | |
| 5,657,904 A | | 8/1997 | Frates et al. | |
| 6,048,057 A | * | 4/2000 | Kanemoto et al. | 347/88 |
| 6,109,803 A | * | 8/2000 | Yasui et al. | 400/320 |
| 6,175,101 B1 | | 1/2001 | Miller et al. | |
| 7,210,773 B2 | | 5/2007 | Jones | |
| 7,731,345 B2 | * | 6/2010 | Park et al. | 347/88 |
| 2004/0114007 A1 | | 6/2004 | Leighton | |
| 2008/0117266 A1 | | 5/2008 | Esplin et al. | |

FOREIGN PATENT DOCUMENTS

| | | |
|---|---|---|
| EP | 0847862 | 6/1998 |
| WO | 8808514 | 11/1988 |

OTHER PUBLICATIONS

European Search Report corresponding to European Patent Application 10152115, European Patent Office, Rijswijk, Netherlands, May 31, 2010 (9 pages).

* cited by examiner

*Primary Examiner* — Anh T. N. Vo
(74) *Attorney, Agent, or Firm* — Maginot, Moore & Beck, LLP

(57) ABSTRACT

A phase change ink melting assembly includes a tub having an open top, a bottom surface, and a plurality of side walls extending upwardly from the bottom surface. The bottom surface has a solid ink melt region and a melted ink outlet offset from the solid ink melt region. The solid ink melt tub includes a three dimensional area extending from the bottom surface in the solid ink melt region. At least one constraining surface is positioned proximate the open top of the melt tub above the solid ink melt region tub and thermally isolated from the melt tub. The at least one constraining surface is configured to prevent lateral movement of an ink stick as it is being fed downwardly into contact with the solid ink melt region.

19 Claims, 7 Drawing Sheets

SOLID INK MELT TUB WITH CORRUGATED MELT REGION AND OFFSET OUTLET

TECHNICAL FIELD

This disclosure relates generally to phase change ink jet imaging devices, and, in particular, to ink melt assemblies used in such imaging devices.

BACKGROUND

Solid ink or phase change ink printers conventionally use ink in a solid form, either as pellets or as ink sticks of colored cyan, yellow, magenta and black ink, that are inserted into feed channels through openings to the channels. Each of the openings may be constructed to accept sticks of only one particular configuration. After the ink sticks are fed into their corresponding feed channels, they are urged by gravity or a mechanical actuator to a solid ink melting assembly of the printer.

Previously known ink melting assemblies typically included substantially flat, heated melt plates that were oriented at least somewhat vertically. One issue with the use of flat melt plates is the limited surface area of the melt plate that may be contacted by an ink stick which in turn limits the rate at which ink may be melted and supplied to the printheads. Faster print speeds require more ink melt in a given span of time. Phase change ink may be damaged by over heating so simply increasing the temperature generated by the melt plate to increase the melt flow rate may not be practical.

In addition, while the vertical orientation of the plates enabled the melted ink to flow down the plates to a drip point to control the flow of ink, the vertical orientation of the plates necessitated a somewhat horizontal feed path in order to bring solid ink sticks in contact with the plates. Feed paths in some phase change ink imaging devices may be vertical or include vertical feed sections which allow gravity to be the driving force that urges or moves ink along the fed path and into contact with a melt plate. Flat, horizontally oriented melt plates, however, may not be adequate to direct the flow of molten ink in a controlled fashion.

SUMMARY

In order to increase the rate that solid ink is melted in a phase change ink imaging device, a phase change ink handling system has been developed that includes an ink melt tub for solid ink having an elevated, three dimensional melt region and at least one outlet opening that is offset from the melt region. In one embodiment, a phase change ink melting assembly includes a tub having an open top, a bottom surface, and a plurality of side walls extending upwardly from the bottom surface. The bottom surface has a solid ink melt region and a melted ink outlet offset from the solid ink melt region. The solid ink melt tub includes a three dimensional area extending from the bottom surface in the solid ink melt region. At least one constraining surface is positioned proximate the open top of the melt tub above the solid ink melt region of the tub and thermally isolated from the melt tub. The at least one constraining surface is configured to prevent lateral movement of an ink stick as it is being fed downwardly into contact with the solid ink melt region.

In another embodiment, a phase change ink loader is provided that includes at least one solid ink feed channel having an insertion end and a melt end. The solid ink feed channel is configured to move solid ink sticks from the insertion end to the melt end. A solid ink melting assembly is provided for each solid ink feed channel. Each solid ink melting assembly includes a tub having an open top, a bottom surface, and a plurality of side walls extending upwardly from the bottom surface. The bottom surface includes a solid ink melt region and a melted ink outlet offset from the solid ink melt region. At least one melted ink channel extends between the solid ink melt region and the melted ink outlet that may be slanted downwardly from the solid ink melt region to the at least one melted ink channel. The solid ink melt region is positioned proximate the melt end and includes one or a plurality of risers or depressions extending from the bottom surface. The solid ink melting assembly includes a heater for heating the tub to a phase change ink melting temperature.

In yet another embodiment, a phase change ink imaging device is provided that includes a plurality of solid ink feed channels, each feed channel in the plurality being configured to move ink sticks toward a melt end of the feed channel. A solid ink melting assembly is provided for each solid ink feed channel in the plurality. Each solid ink melting assembly includes a tub having an open top, a bottom surface, and a plurality of side walls extending upwardly from the bottom surface. The bottom surface includes a solid ink melt region and a melted ink outlet offset from the solid ink melt region. At least one melted ink channel extends between the solid ink melt region and the melted ink outlet that may be slanted downwardly from the solid ink melt region to the at least one melted ink channel. The solid ink melt region is positioned proximate the melt end and includes one or a plurality of risers or depressions extending from the bottom surface. The solid ink melting assembly includes a heater for heating the tub to a phase change ink melting temperature. The imaging device includes at least one printhead configured to receive melted ink from a melt tub.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
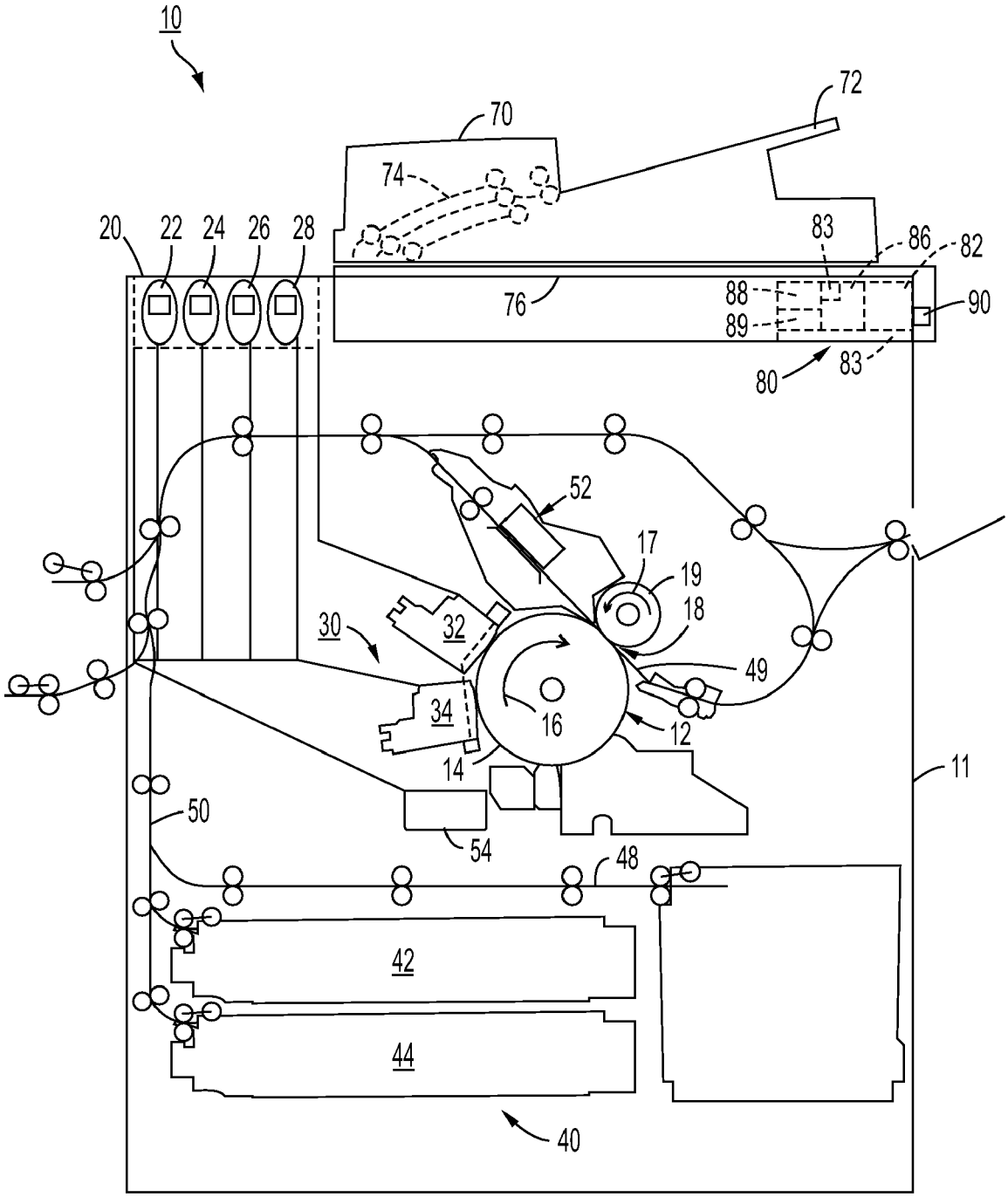
FIG. 1 is block diagram of a phase change ink image producing machine.

For a general understanding of the present embodiments, reference is made to the drawings. In the drawings, like reference numerals have been used throughout to designate like elements.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Print media" can be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

Referring now to FIG. 1, an embodiment of an imaging device, such as a high-speed phase change ink imaging device 10 of the present disclosure, is depicted. As illustrated, the device 10 includes a frame 11 to which are mounted directly or indirectly all its operating subsystems and components, as described below. To start, the high-speed phase change ink imaging device 10 includes an imaging member 12 that is shown in the form of a drum, but can equally be in the form of a supported endless belt. The imaging member 12 has an imaging surface 14 that is movable in the direction 16, and on which phase change ink images are formed. A heated transfix roller 19 rotatable in the direction 17 is loaded against the surface 14 of drum 12 to form a transfix nip 18, within which ink images formed on the surface 14 are transfixed onto a heated copy sheet 49.

The device 10 includes a phase change ink loader 20 that is configured to receive phase change ink in solid form, referred to herein as solid ink or solid ink sticks. The ink loader 20 also includes a phase change ink melting assembly (FIG. 4) for melting or phase changing the solid form of the phase change ink into a liquid form. Phase change ink is typically solid at room temperature. The ink melting assembly is configured to heat the phase change ink to a melting temperature selected to phase change or melt the solid ink to its liquid or melted form. Currently, common phase change inks are typically heated to about 100° C. to 140° C. to melt the solid ink for delivery to the printhead(s). Thereafter, the phase change ink handling system is configured to communicate the molten phase change ink to a printhead system including one or more printheads, such as printhead 32 and 34 depicted in FIG. 1. Any suitable number of printheads or printhead assemblies may be employed.

As further shown, the phase change ink image producing machine or printer 10 includes a substrate supply and handling system 40. The substrate supply and handling system 40, for example, may include sheet or substrate supply sources 42, 44, 46, 48, of which supply source 48, for example, is a high capacity paper supply or feeder for storing and supplying image receiving substrates in the form of cut sheets 49, for example. The substrate supply and handling system 40 also includes a substrate or sheet heater or preheater assembly 52. The phase change ink image producing machine or printer 10 as shown may also include an original document feeder 70 that has a document holding tray 72, document sheet feeding and retrieval devices 74, and a document exposure and scanning system 76. An offset style printer is depicted and described herein but a direct to media imaging method is equally applicable to the present concept.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and may be connected to a display or user interface (UI) 86. The ESS or controller 80 for example includes sensor input and control 88 as well as a pixel placement and control 89. In addition the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling the machine subsystems and functions.

Figure 2:
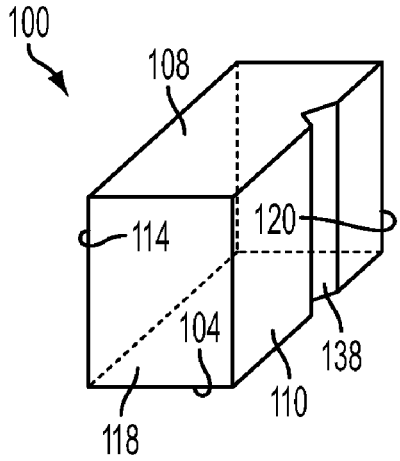
FIG. 2 is a perspective view of an embodiment of a solid ink stick for use with the image producing machine of FIG. 1.

As illustrated, the device 10 is a multicolor imaging device includes a phase change ink handling system 20 configured for use with four different colors of solid ink, e.g., cyan, magenta, yellow, and black (CMYK). The device 10, however, may be configured to use more or fewer different colors or shades of ink. One exemplary solid ink stick 100 for use in the phase change ink handling system is illustrated in FIG. 2. The exemplary ink stick 100 has a bottom surface 104 and a top surface 108. The particular bottom surface 104 and top surface 108 illustrated are substantially parallel one another, although they can take on other contours and relative relationships. Moreover, the surfaces of the ink stick body need not be flat, nor need they be parallel or perpendicular one another. The ink stick body also has a plurality of side extremities, such as lateral side surfaces 110, 114 and end surfaces 118, 120. The side surfaces 110 and 114 are substantially parallel one another, and are substantially perpendicular to the top and bottom surfaces 108, 104. The end surfaces 118, 120 are also substantially parallel one another, and substantially perpendicular to the top and bottom surfaces, and to the lateral side surfaces. One of the end surfaces 118 is a leading end surface, and the other end surface 120 is a trailing end surface. The ink stick body may be formed by pour molding, injection molding, compression molding, or other known techniques.

Figure 3:
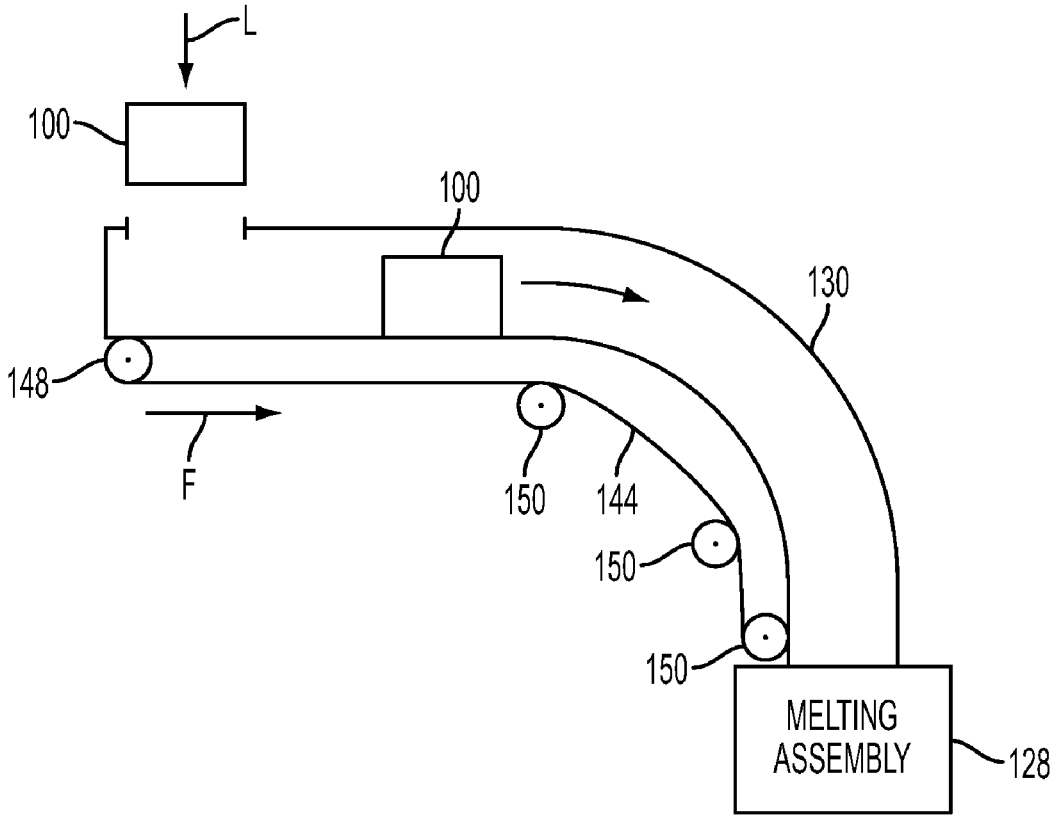
FIG. 3 is a schematic diagram of a phase change ink handling system for use in the imaging device of claim 1.

Referring again to FIG. 3, the ink loader 20 includes a plurality of channels, or chutes, such as channel 130, for advancing solid ink sticks 100 to a melting assembly 128. Although a single channel 130 is depicted in FIG. 3, a separate channel is utilized for each of the four colors of ink, CMYK. The ink loader includes insertion openings 134 that provide access to the feed channels 58 of the ink delivery system. The feed channels receive ink sticks inserted through the openings 134 in an insertion direction L. In the embodiment of FIG. 3, the insertion direction L is substantially vertical, i.e., parallel to the direction of gravitational force. The feed channels are configured to transport ink sticks in a feed direction F from the loading station to the melting station. In the embodiment of FIG. 3, the insertion and feed directions L, F are different. For example, ink sticks may be inserted in the vertical insertion direction L and then moved in a horizontally oriented feed direction F, at least initially. In an alternative embodiment, the feed channels and openings may be oriented such that the insertion and feed directions L, F are substantially parallel.

To aid in the correct insertion of ink sticks into the feed channels, ink sticks may be provided with key contours. Key contours may comprise surface features formed into the ink stick such as protrusions and/or indentations that are located in different positions on an ink stick for interacting with complementarily shaped and positioned key elements in the insertion openings of the printer. As an example, the ink stick of FIG. 2 includes an insertion key contour 138. The insertion key contour 138 is configured to interact with keyed insertion openings 134 (FIG. 4) of the ink loader to admit or block insertion of the ink sticks through the insertion opening 134. In the ink stick embodiment of FIG. 2, the key contour 138 is a vertical recess or notch formed in side surface 110 of the ink stick body substantially parallel to the insertion direction L of the ink loader. A complementarily shaped key element (140, FIG. 4) is included on the perimeter of the keyed openings 134. Key contours and corresponding key elements, however, may have any suitable shape including rounded, angled, stepped, etc. In the referenced illustrations, the insertion opening key contour 140 and complementary key contour 138 of the ink stick are nearly identical for ease of visualization but the shapes need not match to accomplish the keying function.

Figure 4:
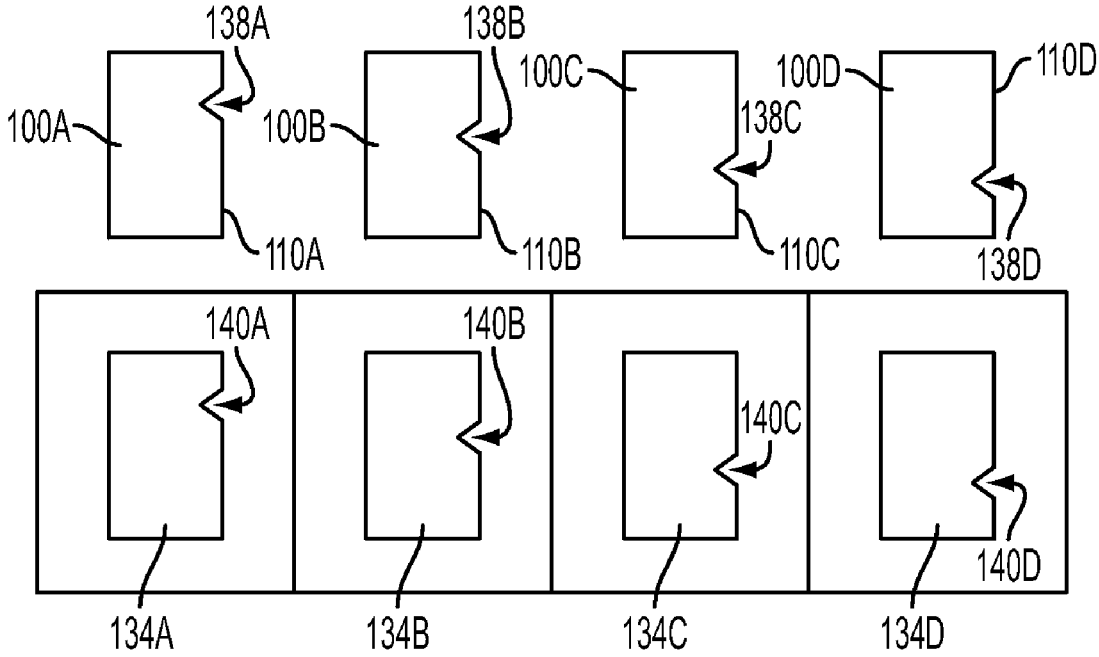
FIG. 4 is a top view of a set of ink sticks having key contours and complementarily keyed insertion openings.

Each color for a printer may have a unique arrangement of one or more key elements in the outer perimeter of the ink stick to form a unique cross-sectional shape for that particular color ink stick. The combination of the keyed openings and the keyed shapes of the ink sticks insure that only ink sticks of the proper color and type are inserted into each feed channel. A set of ink sticks is formed of an ink stick of each color, with a unique key feature arrangement for ink sticks of each color. FIG. 4 shows an example of how insertion key contours 138 may be used to differentiate ink sticks of different colors. There is a set of multi-color ink sticks 10A-100D depicted in FIG. 4 with each ink stick in the stick being of a different color, e.g. cyan, magenta, yellow, and black. As can be seen, each ink stick in the set includes a color key contour, or element 138A-D. The key contours 138A-D are of substantially the same size and shape as one another, but are in different positions along the insertion perimeter of the ink sticks 100A-100D. In this embodiment, the color key contour 138A-D is positioned along the same lateral side surface 110A-D on each ink stick in the set although the color key contours may be positioned along substantially any surface of each ink stick. In this embodiment, the ink sticks of the set are differentiated from each other by positioning the key contour 138A-D in a different position along the lateral side surface 110A-D for ink stick.

The feed channels have sufficient longitudinal length so that multiple ink sticks may be sequentially positioned in the feed channel. The feed channel 130 for each ink color retains and guides ink sticks 100 so that the sticks progresses along a desired feed path. The feed channels 130 may define any suitable path for delivering ink sticks from the insertion openings 134 to the melting assembly 128. For example, feed channels may be linear and/or non-linear and may be horizontally and/or vertically oriented or any or all portions of the channels may be at any other angle relative to horizontal. In the embodiment of FIG. 3, the feed channel 130 is initially horizontally oriented and is curved downward toward the melting assembly 128 such that ink sticks are fed into the melting assembly in a vertical orientation. The downwardly vertical orientation of the feed channel at the melt end allows gravity to provide the primary (or additional) force for transporting ink sticks toward the melting assembly 128. An arcuate portion of the feed path may be short or may be a substantial portion of the path length. The full length of the chute may be arcuate and may consist of different or variable radii. A linear portion of the feed path may likewise be short or a substantial portion of the path length.

As depicted in FIG. 3, the feed channel 130 includes a drive member 144 for moving one or more ink sticks 100 along the feed path in the respective feed channel 130. A separate drive member 144 may be provided for each feed channel. The drive member 64 may have any suitable size and shape. The drive member 64 may be used to transport the ink over all or a portion of the feed path and may provide support or guidance to the ink and may be the primary ink guide over all or a portion of the feed path. In the embodiment of FIG. 3, the drive member 144 comprises a belt that extends along a substantial portion of the path of the feed channel 130. The belt 144 may, as shown in FIG. 3, have a planar or circular cross-section and may be held taut by a pair of spaced apart pulleys in the form of a drive pulley 148 and one or more idle pulleys 150. The drive pulley 148 may be rotated by any suitable device such as, for example, by a motor assembly (not shown). The motor may be bi-directional for moving ink sticks 100 forward and backward along the feed path.

The melting assembly 128 is configured to receive solid ink from the feed channels, to melt the solid ink, and to communicate the melted ink to one or more printheads of the printhead system 110. Previously known ink melting assemblies typically included substantially flat, heated melt plates that were oriented at least somewhat vertically. One issue with the use of flat melt plates is the limited surface area of the melt plate that may be contacted by an ink stick which in turn limits the rate at which ink may be melted and supplied to the printheads. Faster print speeds require more ink melt in a given span of time. Phase change ink may be damaged by over heating so simply increasing the temperature generated by the melt plate to increase the melt flow rate may not be practical. In addition, while the vertical orientation of the plates enabled the melted ink to flow down the plates to a drip point to control the flow of ink, the vertical orientation of the plates necessitated a somewhat horizontal feed path in order to bring solid ink sticks in contact with the plates. Feed paths in some phase change ink imaging devices may include vertical feed sections which allow gravity to be the driving force that urges or moves ink along the fed path and into contact with a melt plate. Flat, horizontally oriented melt plates, however, may not be adequate to direct the flow of molten ink in a controlled fashion.

Figure 5A:
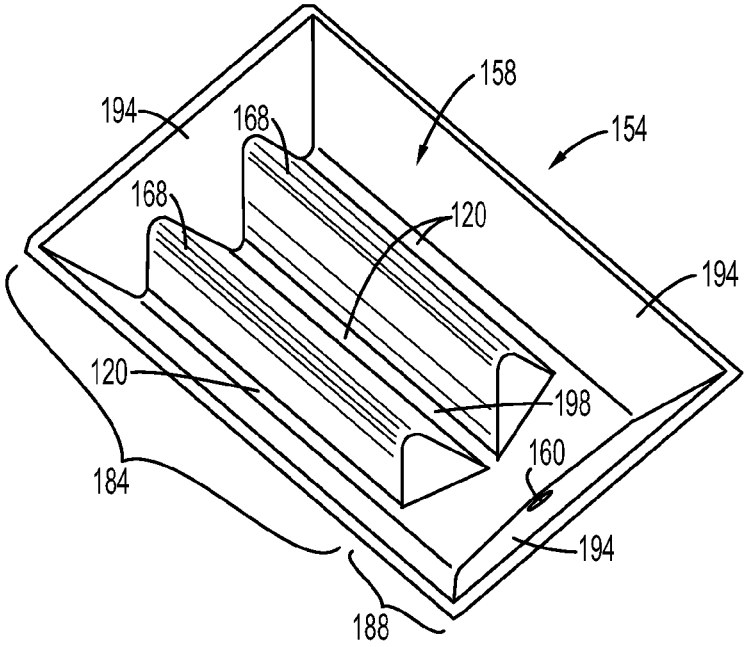
FIG. 5A is a perspective view of an embodiment of a melting assembly in the form of a melt tub.
Figure 5B:
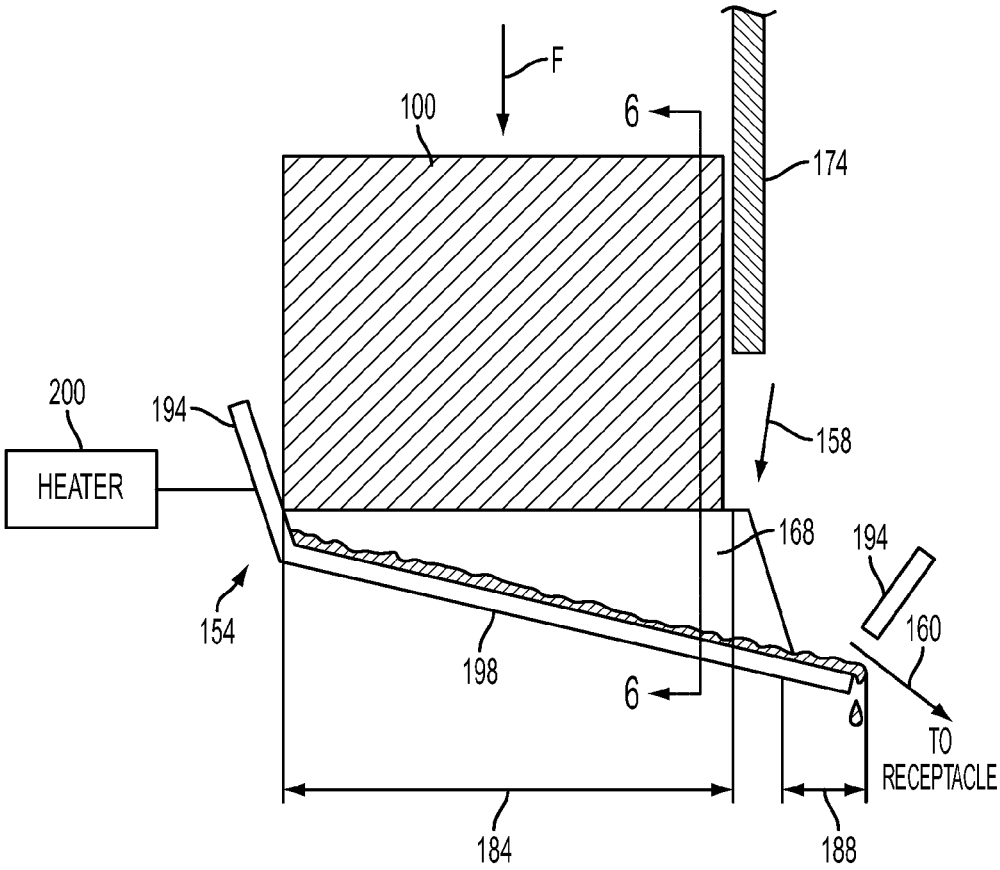
FIG. 5B is a schematic cross-sectional diagram of the melt tub of FIG. 5A.

Accordingly, as an alternative to the use of flat, vertically oriented plates for melting solid ink, the present disclosure is directed to a melting assembly that includes a melt tub for solid ink having a three dimensional melt region that significantly increases the melt surface area to which an ink stick is exposed relative to a flat plate. Referring now to FIGS. 5A and 5B, an embodiment of a melting assembly 128 in the form of a melt tub is illustrated. As depicted in FIG. 5A, the melting assembly 128 includes a thermally conductive ink melt tub 154 having a bottom surface 198 and a plurality of side wall(s) 194 that at least partially enclose an internal melting area that is configured to expose a solid ink stick 100 received therein to a much greater surface area than is generally possible using a flat heated plate. The tub 154 has an open top 158. The bottom surface 198 includes a solid ink melt region 184 and a melted ink collecting region 188 that is offset from the solid ink melt region.

The melt region 184 in FIG. 5A has a three-dimensional topography that includes surface features 168 that protrude from or are recessed into the bottom surface 198 of the tub and that function to increase the melting surface area in the tub to which the solid ink is exposed after being fed into the enclosure. The melted ink collecting region 188 includes at least one melted ink outlet 160 that is positioned near the bottom of the tub 154 through which melted ink is directed to a melted ink receptacle (not shown). The solid ink melting region 184 of the melt tub has a size that corresponds substantially to ink stick size. The melted ink collecting region 188 is small compared to the melting region 184 and offset a short distance from the melting region in order to limit the lateral expanse of the melt tub. The collecting region, however, may have any suitable size and may be offset any suitable distance form the melting region. The surface features 168 shown in FIG. 5A comprise protrusions or risers that extend upwardly from the bottom surface 198 of the tub in the melt region 184. The risers 168 of FIG. 5A have sloped or angled surfaces that guide the flow of ink to a plurality of melted ink flow channels 170 between the risers. The melted ink channel(s) 170, in turn, are sloped or angled from the melting region toward the collecting region to direct ink flow to the ink outlet in the melted ink collecting region.

The walls, surfaces, and risers of the melt tub may have a number of suitable configurations. For example, side walls may extend upwardly from the bottom surface substantially vertically or may be angled outwardly with respect to the bottom surface as depicted in FIGS. 5A and 5B. In the embodiment of FIG. 5B, the sidewalls each extend substantially the same distance from the bottom surface so that the top edges of the sidewalls 194 are substantially parallel to the bottom surface of the tub. The sidewalls, however, may extend different distances and may be arranged so that, for example, the top edges of the sidewalls are all substantially horizontal. Top surfaces of risers may be perpendicular to the direction of ink stick feed F into the tub as depicted in FIG. 5B, or may be angled downwardly toward the collecting region to further facilitate ink flow. In the embodiment of the melt tub of FIG. 5A, the top edges of the side walls, top surfaces of the risers, and the bottom surface have a substantially parallel configuration in which the top edges of the side walls that define the open top 158, the top edges of the risers 168, and the bottom surface 198 are all substantially parallel. Ink flow may be directed from the melting region toward the collecting region using the melt tub of FIG. 5A by mounting the melt tub in a tilted fashion at the appropriate location in the imaging device. Liberties were taken to depict the section view of FIG. 5B with an alternative angled riser configuration to emphasize the configuration flexibility inherent in the use of a melt tub such as described above.

As best seen in FIG. 5B, the ink stick is fed into the tub into contact with the solid ink melt region 184 via the open top 158 in a feed direction F that is substantially parallel to the direction of gravitational force. At least one constraining surface 174 is positioned over the solid ink melt region to prevent movement of the ink stick in directions other than toward the solid ink melt region. Constraining surfaces 174 are thermally isolated from the ink melt tub so that the constraining surfaces may contact and guide the movement of the ink stick without melting the ink stick. The constraining surfaces 174 may be integral with and form the melt end of the associated feed channel. Constraining surfaces, however, may be independent of the associated feed channel.

Figure 7:
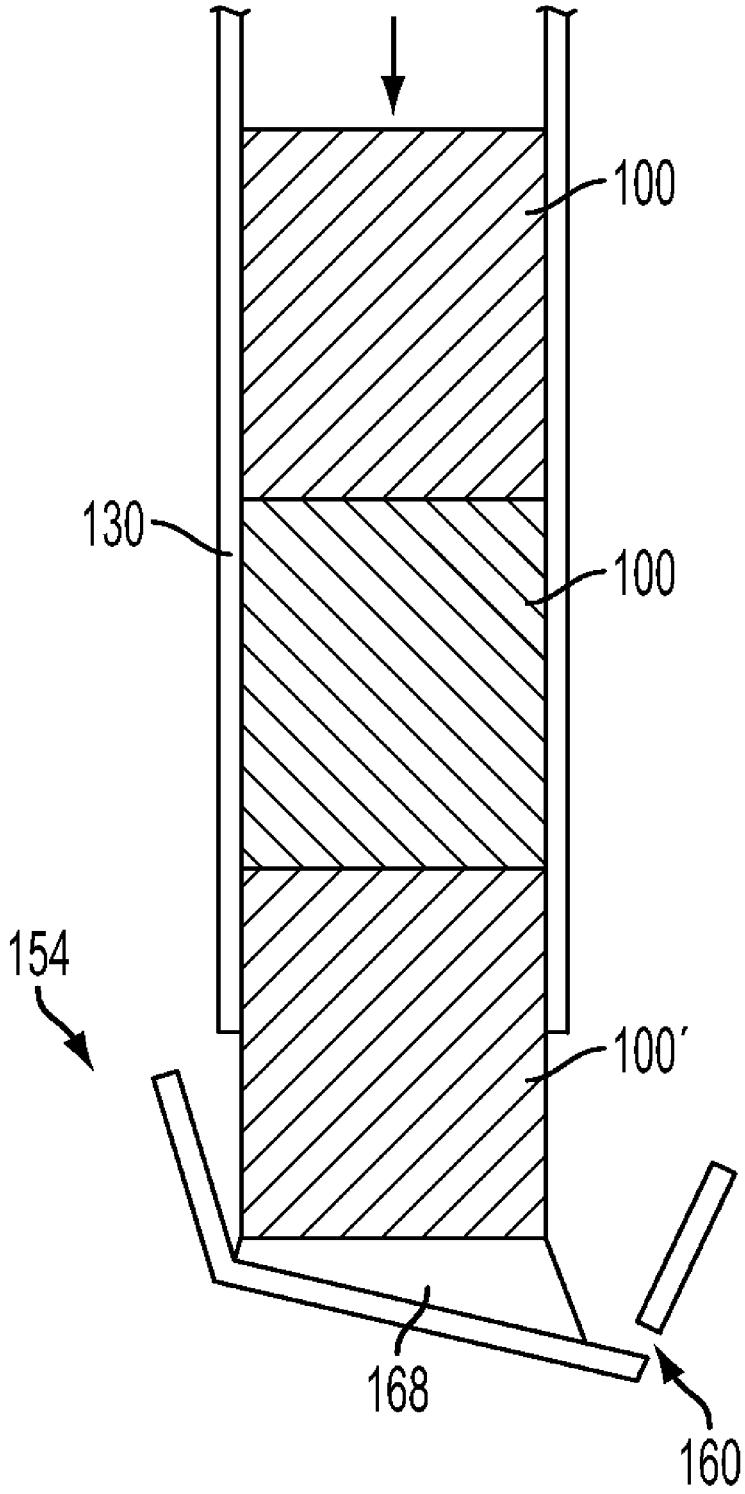
FIG. 7 is a schematic diagram showing the ink melting assembly of FIG. 5 associated with a vertically oriented feed channel section.
Figure 8:
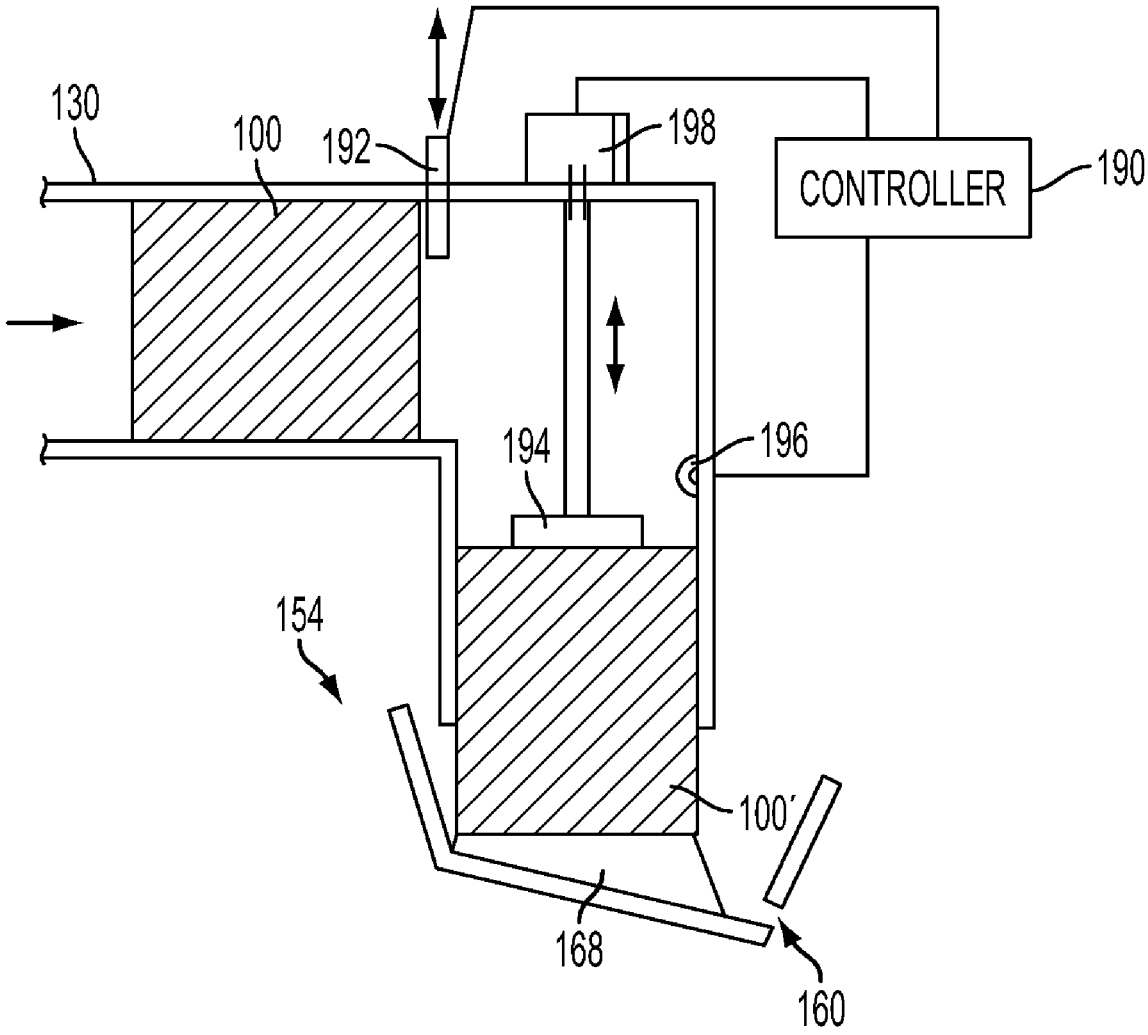
FIG. 8 is a schematic diagram showing the ink melting assembly of FIG. 5 associated with a horizontally oriented feed channel section.

The compliance force for bringing the ink stick into contact may be provided solely by the weight of the ink stick. Additional force may be provided by using a vertically oriented feed channel section to direct ink sticks to the enclosure as depicted in FIG. 7. As depicted in FIG. 7, the vertical orientation of the feed channel 130 allows subsequently inserted ink sticks 100 to stack on top of the lead ink stick 100' and press the ink stick 100' against the solid ink melt region 168. FIG. 8 shows an embodiment of an ink melt tub 154 that is configured to receive ink sticks fed from a horizontally oriented feed section 130. As depicted in FIG. 8, the feed channel 130 may be equipped with a plunger or press-like device or apparatus 194 that is configured to press against the trailing end of the ink stick 100'. In this embodiment, a retractable barrier 192 may be provided in the feed channel 130 to prevent ink sticks 100 from being pushed into the gap over the open top of the tub with the plunger extended. A controller 190 may be configured to actuate the retractable barrier 192 and the plunger 194 based on input received from a sensor system 196 that is configured to detect when there is enough space available in the gap above the enclosure to advance another ink stick.

Figure 6A:
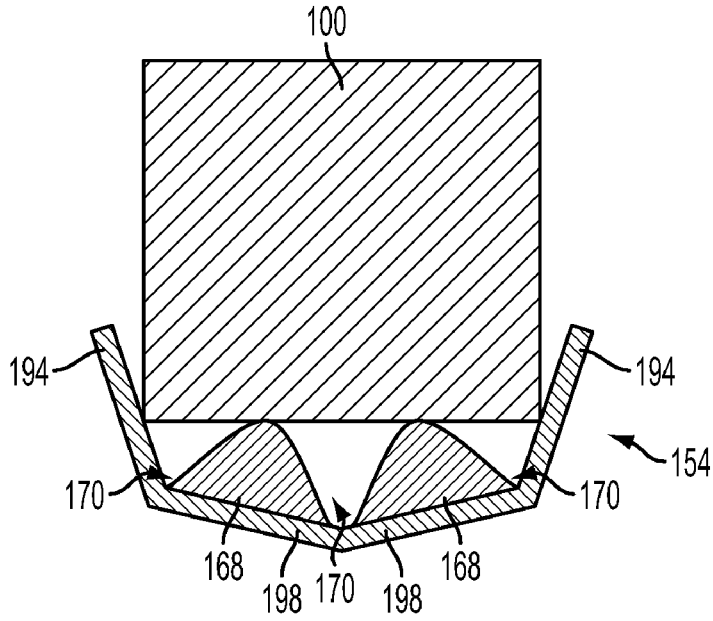
FIG. 6A is a cross-sectional view of the melting assembly of FIG. 5 showing an embodiment of a three-dimensional surface topography for the melting region of the melting assembly of FIG. 5.
Figure 6B:
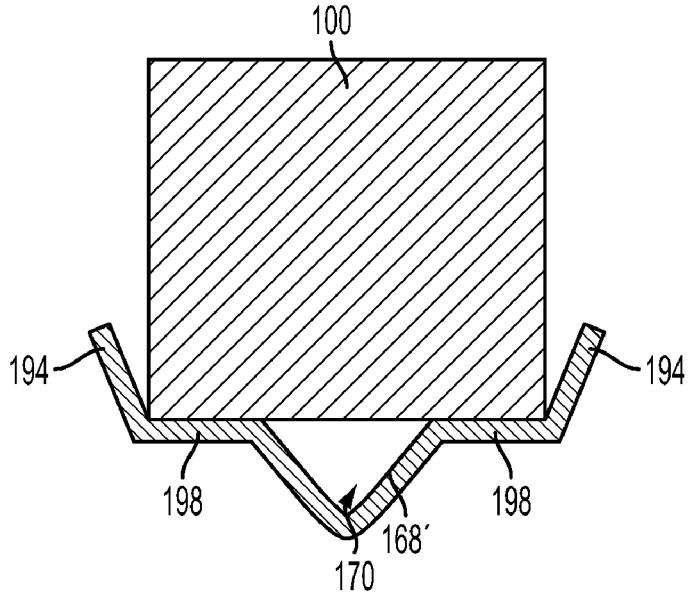
FIG. 6B is a cross-sectional view of a melting assembly showing an alternative embodiment of a three-dimensional surface topography for the melting region of the melting assembly.

Referring again to FIGS. 5A and 5B, the solid ink melt region 188 of the tub has a three-dimensional topography that includes surface features 168 that function to increase the melting surface area in the tub to which the solid ink is exposed after being fed into the enclosure. For example, FIG. 6A is a cross-sectional view of the melt tub of FIG. 5B taken along lines 6-6 that shows one embodiment of a three-dimensional surface topography for the melt region of the tub. As depicted in FIG. 6A, the bottom surface of the tub in the melt region includes risers that protrude from the bottom surface. The top surfaces of the risers 168 contact and at least partially support at least one surface of an ink stick fed into the tub. As an alternative to the use of melt features that protrude from the melting area of the tub, the tub may be provided with depressions or recessed features for increasing the melting surface area in the tub to which the solid ink is exposed. For example, FIG. 6B shows a cross-sectional view of an alternative embodiment of a three-dimensional surface topography for the melt region of the tub that includes at least one recess channel or trough 168'. Any suitable number of recesses or risers may be utilized. For example, a single riser may be used, multiple recessed channels may be used, or a combination of risers and recessed channels may be used.

Although not depicted in FIG. 6A or 6B, as an ink stick contacts the heated surface areas in the melting region, molten and melted ink from the ink stick is forced to the open areas at the sides of the risers (FIG. 6A) or into the recessed channel (FIG. 6B). As the leading surface of the ink stick melts, the melting surface of the ink stick begins to conform to the three-dimensional surface topography in the melting region thus increasing the heated surface area to which the ink stick is exposed. The three dimensional surface topography of the melting region 184 is configured to direct melted phase change ink toward the melted ink collecting region 188 and the ink outlet 160 at the collecting region. In the example of FIG. 6A, the risers have sloped or angled surfaces that guide the flow of ink to a plurality of melted ink flow channels 170 between the risers. The melted ink channel(s) 170, in turn, are sloped or angled from the melting region toward the collecting region to direct ink flow to the ink outlet in the melted ink collecting region.

As depicted in FIGS. 5A and 5B, a single outlet opening 160 is depicted for communicating ink to a single reservoir 164. In alternative embodiments, an outlet opening may be configured to communicate ink to multiple reservoirs. Similarly, multiple outlet openings may be provided that each communicate melted ink to one or more reservoirs or directly to one or more printheads. In the embodiment of FIG. 6, the tub walls converge at least near the bottom of the melter to define the outlet opening 160 so that ink flow is directed thereto. The tub outlet may be a drip opening or the melt tub may include an outlet tip that extends from the exterior of the tub to augment flow control or for connection with a nozzle, tube, umbilical or similar interface or to connect directly to a reservoir or printhead. The tip may be barbed or have other features to augment or facilitate attachment, such feature configurations being well known in the art.

The ink melt tub may be metallic, ceramic, high temperature plastic or any suitable material that can withstand phase change ink melting temperatures and the low feed force or impacts of the ink sticks. The tub may be formed by one or multiple plates. A multi-plate melt tub assemblage may be created by adjoining two or more formed plates by welding, fastened tabs, or any other suitable method or device. In embodiments in which the tub is formed as a single part, the enclosure may be created in multiple ways, as example, by deep drawing, molding the full shape or by bringing the ends of a plate sheet together.

The melting assembly 154 includes a heating system 200 for heating the melt tub to a level capable of melting solid phase change ink. Heating of the enclosure and barrier may be accomplished by any practical means, including as examples, adhered thick film resistive traces, silicone, polyamide film or similar bonded heaters, forming the melter enclosure and/or ribs with a conductive heater material such as ceramic PTC or sputtering the surface with conductive heater material. Isolating resistance coatings or layers may be used prior to applying heater films or traces on electrically conductive materials and may likewise be used as an overcoat to provide electrical insulation as may be required for component isolation and safety. Positive temperature coefficient (PTC) materials and externally applied traces or coatings may also be utilized.

The temperature at which the ink melting assembly is set to be heated may depend upon the solid ink formulation used. In one embodiment, the heater 200 is configured to generate enough heat to maintain ink in the melter assembly within a temperature range of about 100 degrees Celsius to about 140 degrees Celsius. The heater 200 may also be configured to generate heat in other temperature ranges. Separate heaters may be used for the enclosure and the ribs so that each may be heated to a different level.

The outlet opening 160 of the melt tub 154 is configured to direct melted ink to a melted ink receptacle. For example, the receptacle may be a remote melted ink reservoir that supplies the melted ink to one or more printheads as needed. Alternatively, the receptacle may be integrated into a printhead or may be intimately associated with a printhead. Gravity, or liquid ink height, may serve as the driving force for causing the molten ink to exit thought the outlet opening 160 and into the receptacle. Similar to the melt tub, receptacles may include a heating system (not shown) for heating the reservoir to a level capable of melting solid ink and maintaining melted ink in liquid form.

Melted ink receptacles may be capable of holding any suitable amount of ink available for delivery to one or more printheads via at least one discharge opening. In order to decrease the warm up time from an off or standby condition to a ready or operating condition, the receptacles may be made smaller so that it takes less time for ink that has solidified in the receptacle during the off or standby condition to melt. Small sized melted ink receptacles, however, may require the use of a flow stopping function in the melt tub in order to more precisely control the amount of ink that enters the receptacle. For example, when the melt tub heater 200 is powered down, ink melting may continue to occur until the melter temperature falls below the melting temperature of the solid ink. The continued melting of solid ink as the melter temperature decreases may overfill the receptacle or make it difficult to track the amount of ink that enters the reservoir. A flow stopping function may be addressed with the ink melt tub by providing the tub with an operable valve or stopper to quickly stop the ink flow if rapid flow initiation and/or cessation is required by the application. The stopper may be cycled to open and close as needed. Opening to initiate outward flow of melted ink may be an advantage for a small printhead in an ink receiving position for only a brief time. Alternatively or additionally, melted ink flow stopping may be implemented by selectively using wall thickness or other geometry, such as a heat sink, to encourage cool down of melt surfaces near the exit location. Accordingly, in one embodiment, the enclosure walls adjacent the outlet opening of the melter may be thinner than the enclosure walls of the upper portion of the melter. As the thin film of molten ink solidifies it blocks off or inhibits flow that may still be produced from the somewhat distant melt regions, particularly configurations with greater mass such as those with melt ribs or grids. The bonus in reheating when additional melted ink is demanded is that this low mass area will heat easily, quickly initiating ink replenishment.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A phase change ink melting assembly for use in a phase change ink imaging device, the assembly comprising:

a melt tub having an open top, a bottom surface beneath the open top, and a plurality of side walls extending between the bottom surface and the open top, the bottom surface including a solid ink melt region and a melted ink collecting region offset from the solid ink melt region, the solid ink melt region including a three dimensional area extending from the bottom surface in the solid ink melt region, and the melted ink collecting region including at least one melted ink outlet, at least one melted ink channel extends between the solid ink melt region and the melted ink outlet;

at least one constraining surface positioned proximate the open top of the melt tub above the solid ink melt region and thermally isolated from the melt tub, the at least one constraining surface being configured to prevent lateral movement of an ink stick as the ink stick is being fed downwardly into contact with the solid ink melt region; and a heater for heating the tub to a phase change ink melting temperature.

2. The assembly of claim 1, further comprising:

a reservoir configured to receive melted ink via the melted ink outlet, the reservoir including a heater for heating the reservoir to the phase change ink melting temperature.

3. The assembly of claim 1, further comprising:

a feed channel having a melt end positioned proximate the open top of the melt tub, the feed channel being configured to sequentially direct solid ink sticks toward the open top of the melt tub.

4. The assembly of claim 3, the feed channel including an insertion opening through which ink sticks are inserted into the feed channel.

5. The assembly of claim 4, the insertion opening comprising a keyed opening.

6. The assembly of claim 1, the phase change ink melting temperature being between approximately 100° C. and 140° C.

7. The assembly of claim 1, the melted ink outlet including a protruding tip that extends from an exterior of the melt tub.

8. A phase change ink handling system comprising:

at least one solid ink feed channel having an insertion end and a melt end, the solid ink feed channel being configured to move solid ink sticks from the insertion end to the melt end;

a solid ink melting assembly for each solid ink feed channel, each solid ink melting assembly including a melt tub having an open top, a bottom surface, and a plurality of side walls extending upwardly from the bottom surface, the bottom surface including a solid ink melt region and a melted ink outlet offset from the solid ink melt region, at least one melted ink channel extends between the solid ink melt region and the melted ink outlet, the solid ink melt region being positioned proximate the melt end and including a three dimensional area extending from the bottom surface, the solid ink melting assembly including a heater for heating the tub to a phase change ink melting temperature; and at least one constraining surface positioned proximate the open top of the melt tub above the solid ink melt region and thermally isolated from the melt tub, the at least one constraining surface being configured to prevent lateral movement of an ink stick as the ink stick is being fed downwardly into contact with the solid ink melt region.

9. The system of claim 8, each solid ink melting tub further comprising:

at least one outlet configured with at least one ink outflow feature from a set comprised of a drip opening, and a protruding tip.

10. The system of claim 8, the at least one feed channel further comprising:

four feed channels, each feed channel including a keyed opening unique to each different color of ink.

11. The system of claim 10, the melt tub of the solid ink melting assembly having a slope to augment flow of melted ink from the melt region to the melt tub melted ink outlet.

12. The system of claim 8, the phase change ink melting temperature being between approximately 100° C. and 140° C.

13. The system of claim 8, the at least one melted ink channel comprising regions between a plurality of risers.

14. The system of claim 8, the feed channel insertion end having a keyed insertion opening complementary to the ink stick shape intended for insertion into that channel.

15. A phase change ink imaging device including:

a plurality of solid ink feed channels, each feed channel in the plurality being configured to move ink sticks toward a melt end of the feed channel;

a solid ink melting assembly for each solid ink feed channel in the plurality, each solid ink melting assembly including a tub having an open top, a bottom surface, and a plurality of side walls extending upwardly from the bottom surface, the bottom surface including a solid ink melt region and a melted ink outlet offset from the solid ink melt region, the solid ink melt region being positioned proximate the melt end and including a three dimensional area extending from the bottom surface, the solid ink melting assembly including a heater for heating the melt tub to a phase change ink melting temperature;

at least one constraining surface positioned proximate the open top of the melt tub above the solid ink melt region and thermally isolated from the melt tub, the at least one constraining surface being configured to prevent lateral movement of an ink stick as the ink stick is being fed downwardly into contact with the solid ink melt region; and at least one printhead configured to receive melted ink from at least one of the melt assemblies and to eject melted phase change ink onto an imaging surface.

16. The device of claim 15, each feed channel in the plurality including a keyed insertion opening.

17. The device of claim 15, the phase change ink melting temperature being between approximately 100° C. and 140° C.

18. The device of claim 15, the melt region having a plurality of risers.

19. The device of claim 15, the melted ink outlet including a protruding tip extending from an exterior of the melt tub.

* * * * *